United States Patent [19]

Allemann

[11] 4,218,082

[45] Aug. 19, 1980

[54] ANTI-FRICTION LATCH INSERT AND FASTENING MEANS

[75] Inventor: James G. Allemann, Santa Ana, Calif.

[73] Assignee: Norris Industries, Inc., Long Beach, Calif.

[21] Appl. No.: 6,736

[22] Filed: Jan. 26, 1979

[51] Int. Cl.[2] ..... E05C 1/16

[52] U.S. Cl. ..... 292/173; 292/DIG. 56; 292/DIG. 57

[58] Field of Search ..... 292/173, 163, DIG. 56, 292/DIG. 57, 2, 164, 165, 166, 341.12; 70/463

[56] References Cited

U.S. PATENT DOCUMENTS

| | | | |
|---|---|---|---|
| 1,194,636 | 8/1916 | Joy | 292/DIG. 56 |
| 2,159,315 | 5/1939 | Blue | 292/DIG. 56 |
| 2,349,301 | 5/1944 | Overby | 292/DIG. 57 |

*Primary Examiner*—Richard E. Moore

[57] ABSTRACT

The latch bolt assembly makes use of a metal latch bolt head in which is positioned an anti-friction insert extending entirely through a slot in the head from the angled face to the straight face. For holding the insert in place there is a slot in the inside end of the insert engaged by the head on a rod which projects into the inside end of the latch bolt head, in that way to secure the respective parts in interlocked relationship.

11 Claims, 7 Drawing Figures

ANTI-FRICTION LATCH INSERT AND FASTENING MEANS

Various means have been employed heretofore to reduce friction on latches in order to minimize wear. Certain of such expedients have also undertaken to improve the ease of latch manipulation on heavy doors and also to overcome friction when the latch bolt is to be retracted, subject to a warped door condition. Among the more common means which have been employed is that of a mechanical anti-friction lever equipped with a pivotal mechanism which establishes a mechanical advantage in the latch operation.

Other more common expedients employ merely a low-friction material such as one or another of the commercially available synthetic plastic resin materials embedded in the functional surface of the latch bolt head. In the last instance, retention of the anti-friction material is usually accomplished by fitting a plug of the material into a pre-machined recess and staking or pinning it in place. There has also been some resort to embedding an anti-friction plug in the strike plate itself.

With respect to those expedients employed with the latch bolt head, the anti-friction material has been installed only on the angled side, where it reduces friction when the door is closed. There has been little or no attempt heretofore to provide anti-friction expedients on the reverse or straight side of the latch bolt head, where there is need for an anti-friction expedient in cases of warped doors. In virtually all instances in the past, a problem has been experienced in permanently anchoring unlike materials such as plastic and metal together sufficiently securely so that the bond will last as long as the lock mechanism itself.

It is therefore among the objects of the invention to provide a new and improved anti-friction latch insert which is effective as a friction-reducing device on both the angled side and straight side of a latch bolt head.

Another object of the invention is to provide a new and improved anti-friction latch insert and fastening means wherein the anti-friction member can be quickly and easily attached to the metallic portion of the latch bolt head in an effectively permanent fashion, and which is also capable of detachment and removal for replacement.

Another object of the invention is to provide a new and improved anti-friction insert which is capable of being, in effect, integrated with the latch bolt head so that when assembled, the two parts are in stabilized attachment serving together as a unit.

Another object of the invention is to provide a new and improved anti-friction latch insert and fastening means which embodies a yieldable interlocking connection capable of compensating for customary dimensional tolerance variations between sundry interfacing components.

Still another object of the invention is to provide a new and improved anti-friction latch insert and fastening means where the anti-friction effectiveness of the combination is especially suitable to remedy the binding effect of warped doors.

Still another object of the invention is to provide a new and improved anti-friction latch insert and fastening means wherein the fit of the insert with respect to the metallic portion of the latch bolt head provides a solid support for the anti-friction bearing surfaces when the latch is functionally loaded.

When these and other objects in view, the invention consists of a construction, arrangement and combination of the various parts of the device serving as an example only of one or more embodiments of the invention, whereby the objects contemplated are attained, as hereinafter disclosed in the specification and drawings, and pointed out in the appended claims.

Figure 1:
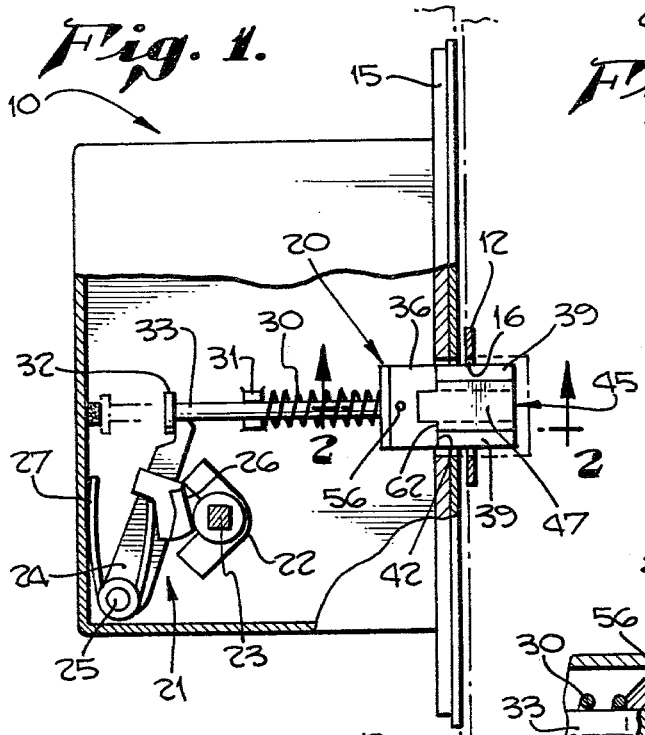
FIG. 1 is a side elevational view of a lock housing broken away to show the latch bolt assembly and associated retract mechanism.
Figure 6:
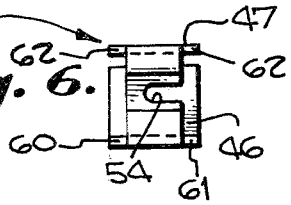
FIG. 6 is a cross-sectional view on the line 6—6 of FIG. 5.

In an embodiment of the invention which has been chosen for illustration, there is shown in FIG. 1 a typical latch case 10 and its contents in the position it would have when mounted upon a door. The door is represented by an edge face 11 which supports a front plate 15 of the latch case 10. The latch case and its contents are adapted to cooperate with a strike plate 12 shown in the position it would have mounted in a door frame, the exposed edge of which is indicated by the reference character 13. The strike plate is conventional, being provided with a strike lip 14 on one edge. In the strike plate is a latch bolt opening 16 having edges 17 and 18 on opposite sides.

In the latch case 10 is a latch bolt member 20. In FIG. 1 the latch bolt member in assembled condition is shown mounted in association with a conventional retract mechanism 21. The retract mechanism consists of sundry components, namely a spindle 23 mounted in a hub 22 which is rotatably mounted in the latch case 10. There is a cam 24 pivotally mounted on a pivot pin 25 in the latch case, the cam being provided with a cam face 26 in cooperation with the hub 22.

A spring 27 acts normally to urge the cam 24 in a clockwise direction about the pivot pin 25 as viewed in FIG. 1. Under such circumstances a coiled latch bolt return spring 30, acting as one element of the latch bolt member 20, serves to normally extend the latch bolt member where the spring 30 is kept by a spring keeper 31 forming part of the latch case 10. A foot 32 on a rod 33 is accordingly urged against the free end of the cam 24. When the hub 22 is rotated by the spindle 23, the cam 24 moving against the foot 32 shifts it in a direction from right to left as viewed in FIG. 1 to the broken line position it would have with the latch bolt withdrawn. Upon release of the spindle, the spring 27 returns the retract mechanism to initial position and the spring 30 again extends the latch bolt assembly outwardly.

Figure 2:
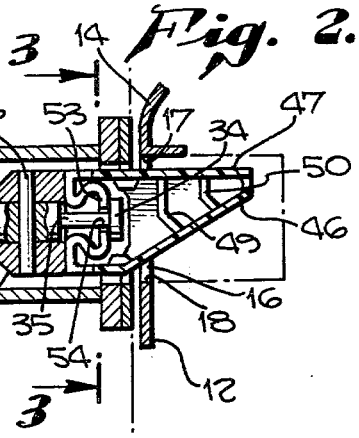
FIG. 2 is a fragmentary longitudinal sectional view on the line 2—2 of FIG. 1.
Figure 7:
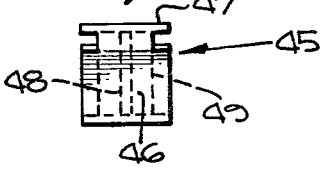
FIG. 7 is an end elevational view on the line 7—7 of FIG. 5.
Figure 4:
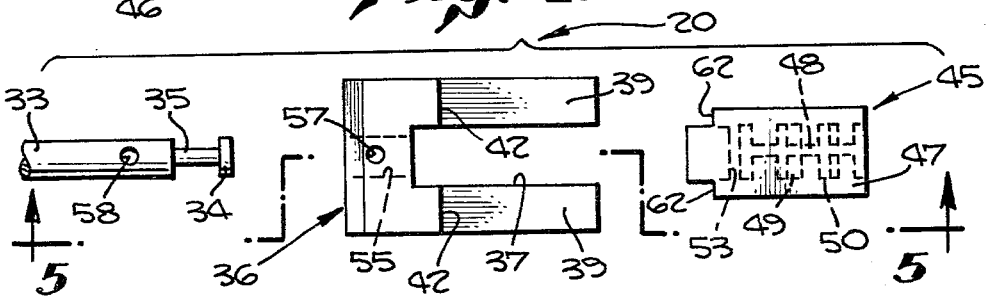
FIG. 4 is an exploded view of the latch bolt assembly.
Figure 5:
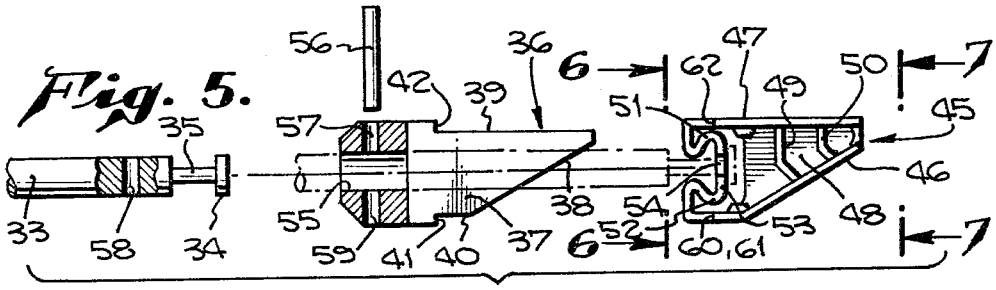
FIG. 5 is a longitudinal sectional view on the line 5—5 of FIG. 4.

As shown to particular advantage in FIGS. 2, 4 and 5, the latch bolt member 20 includes the rod 33, at the right end of which is a head 34 attached to the rod by a reduced portion 35. A latch bolt head 36, usually of metal, is provided with a central recess 37 which extends from an angled face 38 to a straight face 39. On a straight extension 40 of the angled face 38 is a shoulder 41. Similarly there is provided a shoulder 42 adjacent the left end of the straight face 39.

An anti-friction insert indicated by the reference character 45 is preferably of a synthetic plastic resin material of low friction quality and effective wear resistance. The insert 45 has an angled side 46 and a straight side 47. The angled side 46 is adapted to overlie to a degree the angled face 38 of the head 34. Similarly the straight side 47 is adapted to overlie to a degree a portion of the straight face 39 of the head 34. A central vane 48 serves as a reinforcement and spreader between the angled side 46 and straight side 47, additional reinforcement being provided by means of ribs 49 and 50. The distance between ends of the ribs on opposite sides of the insert 45, as shown in broken lines in FIG. 4, is such as to permit the insert to slide freely into the recess 37 while portions of the angled side 46 and straight side 47 slidably overlie the corresponding faces of the head.

At the left end of the insert 45, as viewed in FIGS. 2, 4 and 5, are folds 51 and 52, spring-like in character, supporting between them a flat area 53. In the flat area 53 is a notch 54 of sufficient breadth to receive the reduced portion 35 at the right hand end of the rod 33 adjacent the head 34.

When assembling the insert 45 with the latch bolt head 36 the head 34 of the rod is pushed through a passageway 55 to the extended broken line position of FIG. 5 in which position the spring 30 is compressed. With the head 34 of the rod thus extended, it can be applied over the flat area 53 as the reduced portion 35 of the rod is projected into the notch 54. Upon attachment of the anti-friction insert 45 in the manner described, the rod 33 is retracted, drawing the head of the rod 34 and the attached insert 45 into position, as shown in FIG. 2. This is the assembled position. Once in assembled position, a retaining pin 56 is inserted through a hole 57 in the latch bolt head 36, then through a hole 58 in the rod 33, and finally through an aligned hole 59 in the latch bolt head 36. The parts are accordingly pinned together in assembled position once the retaining pin 56 has been inserted in place. Thereafter, the latch bolt head 36 and its anti-friction insert 45 serve together as a unit.

Figure 3:
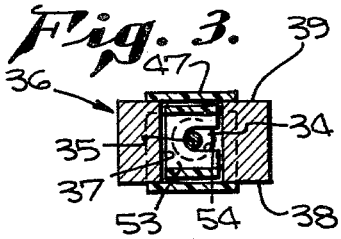
FIG. 3 is a cross-sectional view on the line 3—3 of FIG. 2.

As shown in FIG. 3, the respective opposite sides 46 and 47 of the insert 45 extend to a level outwardly with respect to corresponding faces of the latch bolt head 36 so that when the latch bolt assembly, when in assembled condition, hits the lip 14 of the strike plate, it will be the anti-friction angled side 46 which makes engagement. Similarly, once extended and in place within the latch bolt opening 16 of the strike plate, if there is any binding effect against the straight side, due for example to a warped door condition, the binding effect will be between straight side 47 of the insert and the edge 17. The binding effect is relieved by the anti-friction material, as it may be pressed against an adjacent edge 17 of the latch bolt opening 16 in the strike plate 12. The latch bolt head can, therefore, be more easily withdrawn from engagement with the strike plate.

Further, by reason of the fact that the folds 51 and 52 have a spring-like effect, together with the flat area 53, this spring-like effect will compensate for dimensional tolerance variations between interfacing components. Among these, for example, is the interface of shoulders 60 and 61 of the angled side 46 of the anti-friction insert with the shoulders 41, and the shoulders 62 on the straight side of the anti-friction insert with the shoulders 42 of the latch bolt head.

Having described the invention, what is claimed as new in support of Letters Patent is as follows:

1. An anti-friction latch bolt member comprising a latch bolt head with a rod extending therefrom for mounting and actuating said member, an anti-friction insert on the latch bolt head and an attachment between the insert and the latch bolt head, said attachment comprising spring means forming part of the insert having a slot therein and a projection on a portion of the latch bolt member in releasable engagement with the slot.

2. An anti-friction latch bolt member as in claim 1 wherein said latch bolt head has opposite faces with a recess extending through said latch bolt head from one face to the other and wherein said insert resides in said recess with opposite sides of said insert extending outwardly relative to the respective faces of the latch bolt head.

3. An anti-friction latch bolt member as in claim 2 wherein portions of the insert on each side thereof overlie portions of the respective faces of the latch bolt head.

4. An anti-friction latch bolt member as in claim 2 wherein there are stiffening interconnecting elements between said opposite sides of the insert and located within said recess.

5. An anti-friction latch bolt member as in claim 2 wherein said spring means forming part of said insert is located between said opposite sides.

6. An anti-friction latch bolt member as in claim 2 wherein one of said opposite faces is disposed in an angularly oblique direction with respect to the longitudinal axis of said rod and the other of said faces is parallel to the longitudinal axis of said rod.

7. An anti-friction latch bolt member as in claim 1 wherein said spring means comprises a folded portion of the material of said insert, said slot being a transversely extending slot with an opening at one side, said projection comprising a reduced portion of said rod releasably received in said slot.

8. An anti-friction latch bolt member as in claim 7 wherein said folded portion extends inwardly into the insert from an inside end of said insert at a location intermediate said opposite sides.

9. An anti-friction latch bolt member as in claim 7 wherein said folded portion comprises laterally opposite folds of the material of said insert having an interconnecting flat area with said slot being in said flat area.

10. An anti-friction latch bolt member as in claim 7 wherein there are axially aligned transverse holes respectively in said latch bolt head and said rod and a connecting pin in said axially aligned holes for anchoring said latch bolt head on said rod.

11. An anti-friction latch bolt member as in claim 7 wherein there are abutting shoulders respectively on said latch bolt head and said insert for positioning the insert relative to the latch bolt head.

* * * * *